United States Patent [19]

Tanaka et al.

[11] Patent Number: 5,026,439

[45] Date of Patent: Jun. 25, 1991

[54] PROCESS FOR PREPARING WOUND CORE HAVING LOW CORE LOSS

[75] Inventors: Masaki Tanaka; Norito Abe; Masao Yabumoto; Yoshiyuki Ushigami; Tadao Nozawa, all of Kitakyushu, Japan

[73] Assignee: Nippon Steel Corporation, Tokyo, Japan

[21] Appl. No.: 596,857

[22] Filed: Oct. 12, 1990

[30] Foreign Application Priority Data

Oct. 14, 1989 [JP] Japan ..... 1-267630

[51] Int. Cl.[5] ..... H01F 1/04

[52] U.S. Cl. ..... 148/111; 148/110; 148/112; 148/307

[58] Field of Search ..... 148/110, 111, 112, 113, 148/307, 308, 309

[56] References Cited

U.S. PATENT DOCUMENTS

| | | | |
|---|---|---|---|
| 2,473,156 | 6/1949 | Littmann | 148/111 |
| 4,290,829 | 9/1981 | Koshiishi et al. | 148/112 |
| 4,293,350 | 10/1981 | Ichiyama et al. | 148/111 |

FOREIGN PATENT DOCUMENTS

| | | |
|---|---|---|
| 53-137016 | 11/1978 | Japan . |
| 55-18566 | 2/1980 | Japan . |
| 60-255926 | 12/1985 | Japan . |
| 61-117218 | 6/1986 | Japan . |

*Primary Examiner*—R. Dean
*Assistant Examiner*—Sikyin Ip
*Attorney, Agent, or Firm*—Kenyon & Kenyon

[57] ABSTRACT

The present invention provides a wound core having a low core loss and not susceptible to a disappearance of the core loss lowering effect due to a magnetic domain refining even when stress-relief annealing is conducted after fabrication of a steel strip into a wound core, through a process which comprises, fabricating a very thin silicon steel strip comprising by 6.5% weight or less of silicon with the balance consisting essentially of iron and having a sheet thickness of 100 μm or less and a magnetic flux density ($B_8$ value) of 1.80T or more into a wound core, subjecting the wound core to stress-relief annealing, unwinding the very thin silicon steel strip from the core, introducing into the very thin silicon steel strip a linear or dotted local strain in a direction at an angle of 45° to 90° to the rolling direction of the thin strip, and rewinding the thin strip onto the core.

9 Claims, 3 Drawing Sheets

PROCESS FOR PREPARING WOUND CORE HAVING LOW CORE LOSS

BACKGROUND OF THE INVENTION

1. Field of the Invention

The present invention relates to a process for preparing a wound core having a very low core loss, through the use of a very thin silicon steel strip having an axis of easy magnetization in the direction of rolling.

2. Description of the Related Art

The fundamental magnetic concept of an oriented silicon steel derives from the discovery of a crystal magnetic anisotropy of a single crystal of iron in 1926 (see K. Honda and S. Kaya, Sci. Reps, Tohoku Imp. Univ. 15, 1926, 721). The magnetic characteristics of silicon steel have been remarkably improved by significant advances in the development of a cube-on-edge structure by Goss (N.P. Goss, U.S. Pat. No. 1965,559), and currently, the oriented silicon steel is still considered one of the most useful magnetic materials, due to its low energy loss, high magnetic flux density in a low magnetizing force, and very low cost.

Nevertheless, this steel has significant core loss under a high frequency magnetization, and the magnetic permeability is lowered when the sheet thickness is large (0.20 mm or more as an industrial product), and accordingly, the above-described magnetic materials can be utilized only for a magnetization at 50 Hz or 60 Hz.

In 1949, M.F. Littmann disclosed a process for developing a high magnetic permeability and a low core loss in a very thin silicon steel (see U.S. Pat. No. 2,473,156). In the invention of M. F. Littmann, the starting material has a (110)[001]orientation ($B_8$ =1.74T) and a satisfactory large grain diameter (grain diameter: 0.05 to 10 mm), and is cold-rolled and recrystallized. The above-described silicon steel has characteristics such that, at a sheet thickness of 1 to 5 mils (25.4 to 127 μm), the magnetic flux density ($B_8$ value) and the core loss at 10 kGs in 60 Hz are 1.60 to 1.71T and 0.26 to 0.53 W/lb (0.44 to 0.90 W/kg), respectively. Nevertheless the above-described material (silicon steel) has a magnetic flux density as low as 1 74T at a maximum, in terms of the $B_8$ value, which makes it impossible to increase the required magnetic flux density, and thus the size of power source units in electrical machinery and apparatuses cannot be reduced. Further, since the orientation of the grain frequently deviates from the (110)[001]orientation, a generation and extinction of an auxiliary magnetic domain occur, particularly at an excitation of 1.5T or more, and thus the core loss becomes unfavorably very large.

To solve the above-described problems, the present inventors proposed, in Japanese Patent Application No. 63-322030, a very thin silicon steel strip having a very high magnetic flux density and a low core loss at a high excitation. This proposal, however, has a serious problem of how to achieve a lowering of the core loss through a subdivision of the width of a magnetic domain (domain refining treatment), where a wound core is prepared by using a very thin silicon steel strip. For example, even when the core loss of the silicon steel sheet is reduced through the magnetic domain refining disclosed in Japanese Unexamined Patent Publication Nos. 53-137016 and No. 55-18566, in the case of a wound core, the stress relieving annealing of the steel sheet is conducted after fabrication into a core, which causes the local strain introduced into the steel sheet for the magnetic domain refining to disappear, and accordingly, the core loss lowering effect by the magnetic domain refining is also lost.

For example, Japanese Unexamined Patent Publication Nos. 60-255926 and 61-117218 disclose a technique for controlling the magnetic domain wherein the core loss lowering effect due to the magnetic domain refining is not lost even when a stress-relief annealing is conducted after fabrication of the steel sheet into a core, but when the thickness of the product is as thin as 100 μm or less, it is very difficult to apply the above-described techniques. Therefore, a novel technique for controlling a magnetic domain applicable to the production of a wound core through the use of a very thin silicon steel strip, wherein the core loss lowering effect due to the magnetic domain width subdivision is not lost even when stress-relief annealing is conducted after fabrication of a steel strip into a core, is urgently required.

SUMMARY OF THE INVENTION

The present invention has been made with a view to providing a novel technique for controlling a magnetic domain applicable to the production of a wound core through the use of a very thin silicon steel strip, wherein a core loss lowering effect due to a magnetic domain refining is not lost even when stress-relief annealing is conducted after fabrication of a steel strip into a core.

Accordingly, an object of the present invention is to provide a process for preparing a wound core having a low core loss.

To attain the above-described object, a novel magnetic domain control means is applied to the core subjected to stress-relief annealing after fabrication of a steel strip into a core.

Specifically, the gist of the present invention resides in a process for preparing a wound core having a low core loss, which comprises subjecting a very thin silicon steel strip comprising 6.5% by weight or less of silicon with the balance consisting essentially of iron and having a sheet thickness of 100 μm or less and a magnetic flux density ($B_8$ value) of 1.80T or more, to stress-relief annealing after fabrication into a wound core, unwinding the very thin silicon steel strip from the core, introducing into the very thin silicon steel strip a linear or dotted local strain in a direction at an angle of 45° to 90° to the rolling direction of the thin strip, and winding the strip onto the core.

DESCRIPTION OF THE PREFERRED EMBODIMENTS

The present inventors have made various studies of a novel technique for controlling a magnetic domain applicable to the production of a wound core through the use of a very thin silicon steel strip, wherein a core loss lowering effect by a magnetic domain refining is not lost even when stress relief annealing is conducted after the fabrication of a steel strip into a core, and as a result found that, when a wound core is produced through the use of a very thin silicon steel strip, in the strip subjected to stress relief annealing after fabrication of a steel strip into a core, the very thin silicon steel strip constituting the core can be unwound within the elastic limit, and the unwound strip can be subjected to, e.g., laser beam irradiation, and then rewound onto a core.

Figure 1A:
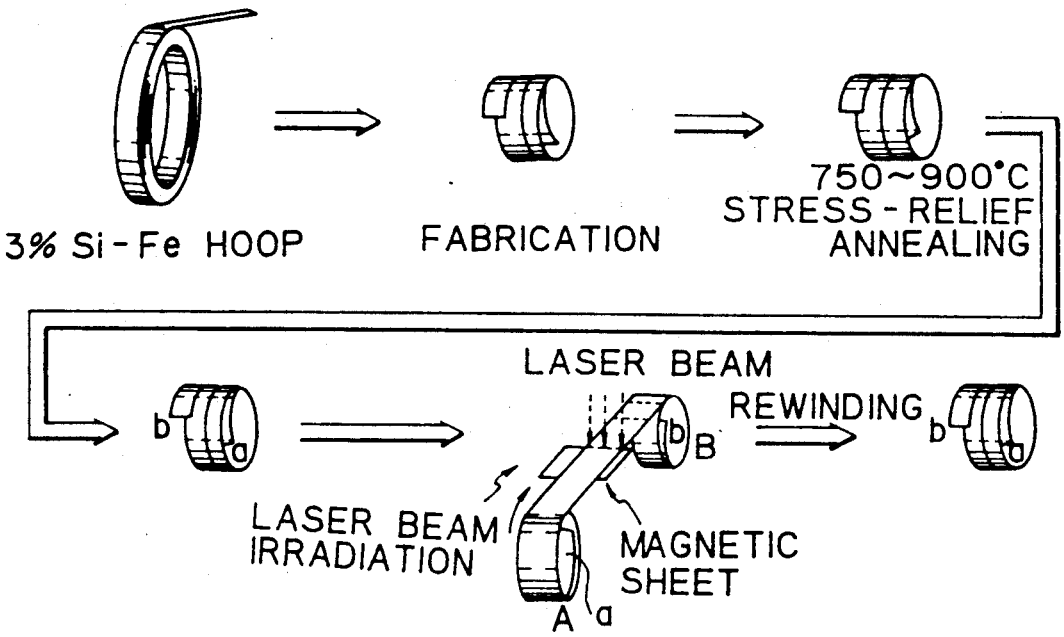
FIG. 1(*a*) is a diagram showing an embodiment of the process of the present invention, and FIG. 1(*b*) is a diagram showing another embodiment of the process of the present invention; and, FIG. 2(*a*) is a graph showing hysteresis loops respectively before laser beam irradiation, and FIG. 2(*b*) is a graph showing hysteresis loops respectively after laser irradiation.
Figure 1B:
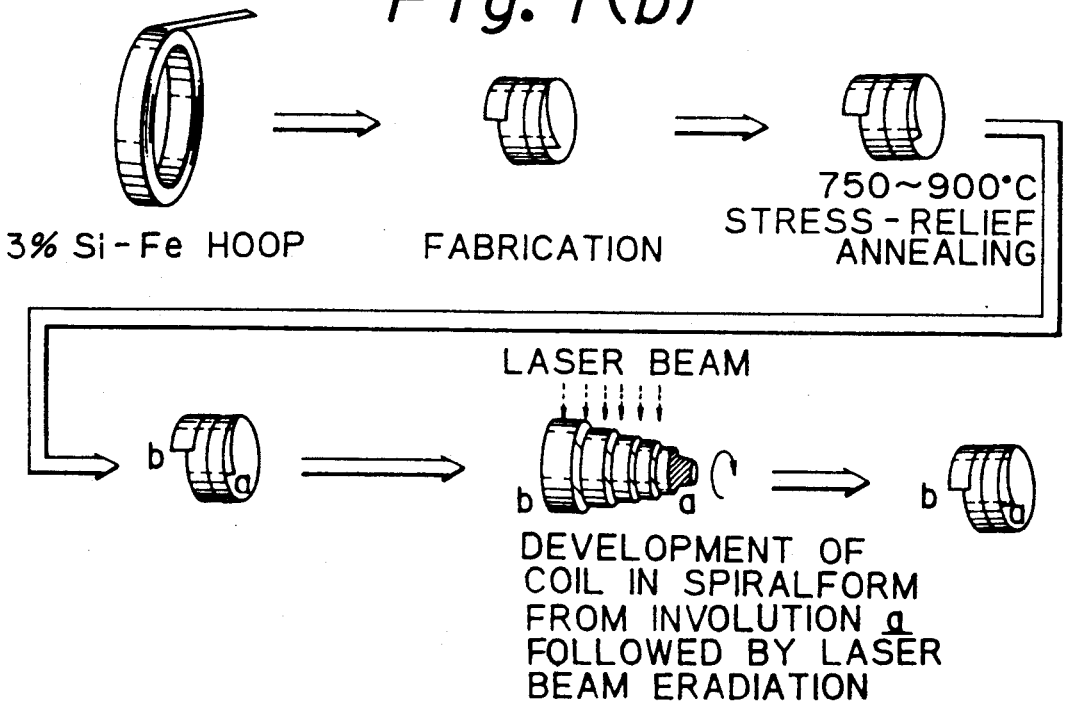

An embodiment of the present invention created by the present inventors will now be described. In this embodiment, the starting material was an oriented silicon steel strip comprising a grain having a silicon content of 3% by weight, a grain texture of a (110)[001]orientation, a magnetic flux density ($B_8$) of 1.80T or more, and average grain diameters of 20 mm and 60 mm or more respectively in the rolling direction and the direction normal to the rolling direction (widthwise direction of the steel strip). This steel strip was cold-rolled at a draft of 60 to 80% to a final sheet thickness of 100 μm or less, and then heat-treated at a high temperature to prepare a very thin silicon steel strip having an average grain diameter of 1.0 mm or less and approximately (110)[001]orientation, and a magnetic flux density ($B_8$) value of 1.80T or more. As shown in FIG. 1 (*a*), the thus prepared very thin silicon steel strip was used to prepare a wound core, the wound core was subjected to stress-relief annealing at 750 to 900° C. for 2 hr with the longitudinal end of the steel strip fastened, the very thin silicon steel strip was unwound and adsorbed on a magnetic sheet to flatten the strip, a laser beam was applied to the surface of the steel strip to introduce a dotted local strain extending in a direction at an angle of 90° to the rolling direction of the steel strip, and the strip was rewound onto a core.

Another embodiment of the present invention created by the present inventors is described as follows. A wound core was prepared in the same manner as that of the above-described embodiment, through the use of a very thin silicon steel strip having a magnetic flux density ($B_8$ value) of 1.80T or more, the wound core was subjected to stress relief annealing at 750° to 900° for 2 hr with the longitudinal end of the steel strip fastened, the very thin silicon steel strip was pulled out from the involution in the axial direction of the wound core as shown in FIG. 1 (*b*), the strip was wrapped round a roll, and in this state, a laser beam was applied to the surface of the steel strip to introduce a dotted local strain extending in a direction at an angle of 90° to the rolling direction of the steel strip, and strip was successively rewound onto a core from the involution.

Through the above-described embodiments, it has been confirmed that even when a very thin steel strip is fabricated into a core, subjected to stress relief annealing, unwound from the core to deform the strip, subjected to magnetic domain refining treatment and then rewound onto a core, the core loss value of the core is excellent and comparable to that obtained where a very thin silicon steel strip is made flat and subjected to a magnetic domain refining treatment, as long as the unwinding is conducted within the elastic limit.

Thus, the present invention enables the magnetic domain refining treatment of a wound core comprising a very thin silicon steel strip in a medium or high frequency power source transformer to be conducted after stress-relief annealing of the core, which contributes to a remarkable reduction in the core loss of the core and renders the process of the present invention very useful from the viewpoint of industry.

The present invention will now be described in detail with reference to the following examples, that by no means limit the scope of the invention.

Example 1

An oriented silicon steel strip comprising a grain having a silicon content of 3.2% by weight, a grain texture of a (110)[001]orientation, a magnetic flux density ($B_8$) of 1.96T or more, and average grain sizes of 30 mm and 130 mm respectively in the rolling direction and the direction normal to the rolling direction (widthwise direction of the steel strip) was used as a starting material. This steel strip was cold-rolled at a draft of 75% to prepare a very thin silicon steel strip having a thickness of 55 μm. The very thin silicon steel strip was annealed in a dry hydrogen atmosphere at 830° C. for 2 min. A core having an inner diameter of 35 mm was prepared from the very thin silicon steel strip product thus prepared and subjected to stress-relief annealing at 850° C. for 2 hr. The steel strip of the wound core was subjected to laser beam irradiation for magnetic domain refining treatment through the process shown in FIG. 1 (*i*). The conditions in this case were as follows.

Laser beam irradiation energy: 1.25 mJ/pulse
Laser beam spot intervals: 0.3 mm
Laser beam line intervals: 1.25 mm The core loss value obtained where a very thin silicon steel strip was made flat and subjected to laser beam irradiation for subdivision of the magnetic domain will be shown below, in comparison with the core loss of the core subjected to laser beam irradiation according to the process of the present invention.

Before irradiation of flat sheet with laser beam:

$$W_{15/400}=11.0 \text{ Watt/kg}$$

After irradiation of flat sheet with laser beam:

$$W_{15/400}=8.0 \text{ Watt/kg}$$

The process of the present invention:
before laser beam irradiation:

$$W_{15/400}=12.0 \text{ Watt/kg}$$

The process of the present invention:
after laser beam irradiation:

$$W_{15/400}=7.8 \text{ Watt/kg}$$

Thus, according to the present invention, an excellent core loss equal or superior to that obtained where a very thin silicon steel strip is made flat and subjected to laser beam irradiation for magnetic domain refining can be realized in the form of a core.

Example 2

A wound core having an inner diameter of 35 mm was prepared under the same condition as that of Example 1 and subjected to measurements of AC magnetization characteristics and DC magnetization characteristics. Then, a laser irradiation treatment was conducted through the process shown in FIG. 1 (*b*), and the magnetization characteristics were measured in the same manner as that described above. The results were as follows.

The process of the present invention:
before laser beam irradiation:

$W_{18/1000}=50.0$ Watt/kg

The process of the present invention:
after laser beam irradiation:

$W_{18/1000}=35.5$ Watt/kg

Figure 2A:
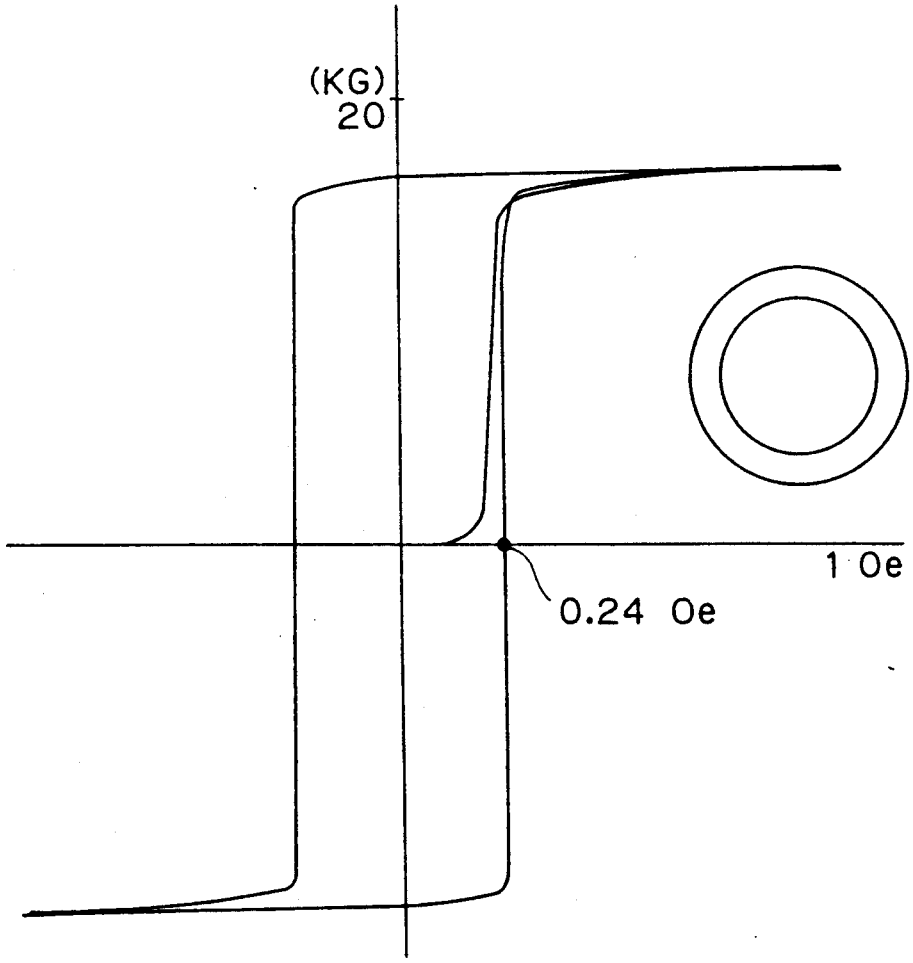
Figure 2B:
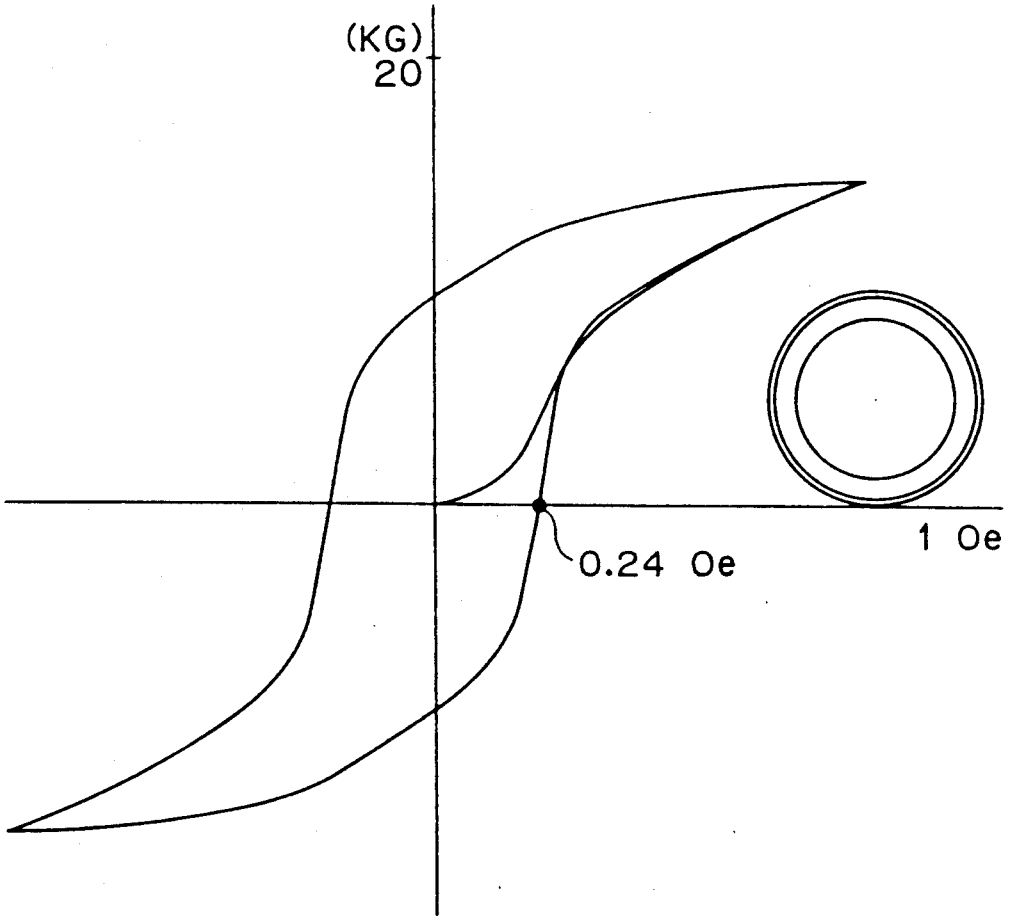

FIG. 2 (*a*) is a graph showing a hysteresis loop of a wound core before laser beam irradiation, and FIG. 2 (*b*) is a graph showing a hysteresis loop of a wound core after laser beam irradiation. As apparent from these drawings, no change in the coercive force, Hc, is observed, and according to the process shown in FIG. 1 (*b*), no residual strain accompanyies the fabrication.

We claim:

1. A process for preparing a core having a low core loss, comprising a step of fabricating a very thin silicon steel strip having a high magnetic flux density into a wound core, a step of subjecting the wound core to stress relief annealing, a step of loosening the wound state of the steel strip in the annealed wound core within the elastic limit to expose the surface of the steel strip, a step of introducing a local strain into the exposed surface of the steel strip, and a step of rewinding the steel strip having a local strain introduced thereinto onto said wound core.

2. A process according to claim 1 wherein, in the step of loosening the wound state of the steel strip in the wound core, the wound core is unwound and rewound around another roll to expose the surface of the steel strip.

3. A process according to claim 1 wherein, in the step of loosening the wound state of the steel strip in the wound core, the inner end portion of the wound core is pulled out to the axial direction of the wound core to expose the surface of the steel strip.

4. A process according to claim 2 wherein, in the step of introducing a local strain into the exposed surface of the steel strip, a linear or dotted local strain is introduced into the surface of the steel strip unwound from the wound core, in a direction at an angle of 45° to 90° to the rolling direction of the steel strip.

5. A process according to claim 3 wherein, in the step of introducing a local strain into the exposed surface of the steel strip, the involution of the wound core is wound around a roll and pulled out in the axial direction of the core to spirally expose the surface of the steel strip, followed by introduction of a linear or dotted local strain into the surface of the steel strip in a direction at an angle of 45° to 90° to the rolling direction of the steel strip.

6. A process according to claim 1, wherein the very thin silicon steel strip comprises 6.5% by weight or less or silicon with the balance consisting essentially of iron.

7. A process according to claim 1, wherein the very thin silicon steel strip has a thickness of 100 μm or less.

8. A process according to claim 1, wherein the very thin silicon steel strip has a magnetic flux density of 1.80T or mbre.

9. A process according to claim 1, wherein the local strain is introduced by irradiating the surface of the steel strip with a laser beam.

* * * * *

UNITED STATES PATENT AND TRADEMARK OFFICE

CERTIFICATE OF CORRECTION

PATENT NO. : 5,026,439

DATED : June 25, 1991

INVENTOR(S) : Tanaka, et al.

It is certified that error appears in the above-identified patent and that said Letters Patent is hereby corrected as shown below:

Column 1, line 38 and 39, "5 mils...." on line 39 should continue on line 38 after "sheet thickness of 1 to".

Column 4, line 23, change "(i)" to --(a)--.

Column 5, line 26, change "a local strain" to --the local strain--.

Signed and Sealed this

Ninth Day of March, 1993

*Attest:*

STEPHEN G. KUNIN

*Attesting Officer*

*Acting Commissioner of Patents and Trademarks*